US012324492B1

(12) United States Patent
He

(10) Patent No.: US 12,324,492 B1
(45) Date of Patent: Jun. 10, 2025

(54) CURVED PIPE UMBRELLA WITH STRUCTURE FOR ADJUSTING INCLINATION ANGLE OF UMBRELLA BODY

(71) Applicant: Zhejiang Qinda Travelling Products Co., Ltd., Zhejiang (CN)

(72) Inventor: Daqin He, Zhejiang (CN)

(73) Assignee: Zhejiang Qinda Travelling Products Co., Ltd., Zhejiang (CN)

( * ) Notice: Subject to any disclaimer, the term of this patent is extended or adjusted under 35 U.S.C. 154(b) by 0 days.

(21) Appl. No.: 19/015,497

(22) Filed: Jan. 9, 2025

(30) Foreign Application Priority Data

Sep. 9, 2024 (CN) ..... 202422206250.2

(51) Int. Cl.
*A45B 17/00* (2006.01)
*A45B 23/00* (2006.01)

(52) U.S. Cl.
CPC ..... *A45B 17/00* (2013.01); *A45B 23/00* (2013.01); *A45B 2023/0012* (2013.01); *A45B 2023/0037* (2013.01); *A45B 2023/0062* (2013.01)

(58) Field of Classification Search
CPC .. A45B 17/00; A45B 23/00; A45B 2023/0037
See application file for complete search history.

(56) References Cited

U.S. PATENT DOCUMENTS 3,383,814 A * 5/1968 Rowe ..... A45B 23/00 135/21
6,953,043 B2 * 10/2005 Yu ..... A45B 23/00 135/21
7,708,022 B2 * 5/2010 Joen-an Ma ..... A45B 23/00 135/21
8,113,223 B2 * 2/2012 Wang ..... A45B 23/00 135/20.1
8,360,080 B2 * 1/2013 Liu ..... A45B 17/00 135/20.1
8,402,981 B2 * 3/2013 Liu ..... A45B 17/00 135/21

(Continued)

FOREIGN PATENT DOCUMENTS

CN 221012246 5/2024
DE 102012213384 A1 * 3/2014 ..... A45B 17/00

*Primary Examiner* — Noah Chandler Hawk
(74) *Attorney, Agent, or Firm* — JCIPRNET

(57) ABSTRACT

A curved pipe umbrella with a structure for adjusting an inclination angle of an umbrella body includes a curved pipe umbrella column. The curved pipe umbrella column includes a first curved pipe umbrella column and a second curved pipe umbrella column. One end of the second curved pipe umbrella column is embedded into an upper inner cavity of the first curved pipe umbrella column and the other end thereof extends outward to match with the umbrella body. A pole bracket is arranged in the umbrella body and matches with the first curved pipe umbrella column through a sliding seat. The curved pipe umbrella further includes an operating mechanism configured to drive the second curved pipe umbrella column. When the operating mechanism drives the second curved pipe umbrella column to stretch and retract, a sliding seat can move along different positions of the first curved pipe umbrella column.

9 Claims, 8 Drawing Sheets

(56) References Cited

U.S. PATENT DOCUMENTS

| | | | | |
|---|---|---|---|---|
| 2005/0268952 | A1* | 12/2005 | Joen-an Ma | A45B 25/18<br>135/20.1 |
| 2008/0236640 | A1* | 10/2008 | Huali | A45B 25/14<br>135/20.3 |

* cited by examiner

CURVED PIPE UMBRELLA WITH STRUCTURE FOR ADJUSTING INCLINATION ANGLE OF UMBRELLA BODY

CROSS-REFERENCE TO RELATED APPLICATION

This application claims the priority benefit of China Application No. 202422206250.2, filed on Sep. 9, 2024. The entirety of the above-mentioned patent application is hereby incorporated by reference and made a part of this specification.

TECHNICAL FIELD

The present invention relates to the technical field of outdoor umbrellas, and particularly relates to a curved pipe umbrella with a structure for adjusting an inclination angle of an umbrella body.

BACKGROUND

Outdoor umbrellas, also referred to as sunshades, can be divided into side column umbrellas, Roman umbrellas, banana umbrellas, and the like according to models, and they are usually single-sided umbrellas. Curved arm hanging umbrellas, as sunshades with a unique model in outdoor sunshades, have a good market and better aesthetic appearance and are popular with many people.

Most curved arm hanging umbrellas use a curved pipe structure. The curved arm hanging umbrella mainly includes an upper curved pipe, a lower curved pipe, an umbrella fabric, and a base. The structure for adjusting the inclination angle of the umbrella fabric is to mount a handle and a locking device on a supporting rod of a main umbrella body. During operation, the locking device is loosened first, and then the supporting rod is manually operated to rotate left and right to control the inclination angle of the umbrella fabric. The curved arm hanging umbrella is troublesome to operate. Cooperation among parts is easily prone to problems, so that it is troublesome to adjust.

For example, a patent with publication No. CN221012246U provides a telescopic curved arm umbrella column structure for an outdoor curved arm hanging umbrella, including a lower curved pipe, an upper curved pipe, and an armrest structure. An opening is formed in a side wall of the lower curved pipe in a length direction thereof. The upper curved pipe is slidably inserted into the lower curved pipe. The armrest mechanism is arranged at a lower end of the upper curved pipe and stretches out from the opening of the lower curved pipe for people to operate, which locks the upper curved pipe on the lower curved pipe.

However, according to the curved arm hanging umbrella in the above structure, the upper and lower curved pipes need to match with the armrest mechanism to push and pull up and down for stretching. A user needs to exert a large force to push and pull the armrest mechanism. Particularly, it is strenuous to operate part of outdoor umbrellas with large umbrella body. For this kind of curved pipe hanging umbrellas, the angle of the inclined plane of the umbrella body cannot be adjusted, so that the curved pipe hanging umbrellas are relatively single in using function.

SUMMARY

To solve the above problems, the present invention is intended to provide a curved pipe umbrella with a structure for adjusting an inclination angle of an umbrella body. The stretching operation of the curved pipe umbrella columns is facilitated, the operating convenience is improved, and multi-angle inclination adjustment for the umbrella body is facilitated.

The present invention may use the following technical solution to solve the technical problems:

A curved pipe umbrella with a structure for adjusting an inclination angle of an umbrella body, including a curved pipe umbrella column, where the curved pipe umbrella column includes a first curved pipe umbrella column and a second curved pipe umbrella column, one end of the second curved pipe umbrella column is embedded into an upper inner cavity of the first curved pipe umbrella column and the other end thereof extends outward to match with the umbrella body, and a pole bracket is arranged in the umbrella body and matches with the first curved pipe umbrella column through a sliding seat; and further including an operating mechanism configured to drive the second curved pipe umbrella column to be folded toward the inner cavity of the first curved pipe umbrella column or extend outward, wherein when the operating mechanism drives the second curved pipe umbrella column to stretch and retract, a sliding seat is capable of moving along different positions of the first curved pipe umbrella column.

Different inclination angles of the umbrella body are capable of being adjusted with the movement of the sliding seat.

The umbrella body further includes an umbrella cloth and an umbrella stand, the umbrella cloth covers the umbrella stand, the umbrella stand comprises an upper umbrella tray, a lower umbrella tray, and an umbrella rib assembly, the second curved pipe umbrella column is configured to match with the upper umbrella tray for mounting, and the other end of the pole bracket matches with the upper umbrella tray for mounting.

An umbrella unfolding and folding mechanism is arranged in the sliding seat to unfold or fold the umbrella body.

The operating mechanism includes a rotating shaft, a rotating gear arranged on the rotating shaft, a chain matching with the rotating gear in a surrounding manner, and a winding rope matching with the chain, one end of the chain is fixedly mounted with the winding rope and the other end thereof matches with a first mounting seat for mounting, and the winding rope surrounds behind a pulley in a second mounting seat and extends to match with the first mounting seat for mounting.

The winding rope, the chain, the first mounting seat, the pulley, and the rotating gear form a closed ring; with rotation of the rotating gear, the chain is capable of being driven to move; the chain pulls the winding rope to move and drives the first mounting seat to move along the inner cavity of the first curved pipe umbrella column, and the first mounting seat drives the second curved pipe umbrella column to stretch and retract in the inner cavity of the first curved pipe umbrella column.

The first mounting seat is fixedly mounted on a lower portion of the second curved pipe umbrella column and is embedded into the inner cavity of the first curved pipe umbrella column, and the second mounting seat is fixed on an upper portion of the first curved pipe umbrella column.

An umbrella column through cavity is formed in the second mounting seat, the second curved pipe umbrella column penetrates through the umbrella column through cavity and is capable of stretching and retracting along the umbrella column through cavity, a pulley seat is arranged in the second mounting seat, and the pulley seat is configured to mount the pulley in a matched manner.

The rotating shaft is driven by a motor and/or a handle to rotate, and a third mounting seat is arranged outside the rotating shaft and the rotating gear.

The third mounting seat is embedded into the inner cavity of the first curved pipe umbrella column.

Compared with the prior art, the present invention has the following beneficial effects: according to the present disclosure, by optimally designing the operating mechanism, the second curved pipe umbrella column can stretch and retract in the inner cavity of the first curved pipe umbrella column conveniently. In combination with the pole bracket and the sliding seat, with the movement of the second curved pipe umbrella column, the sliding seat can be synchronously driven to move to adjust different inclination angles of the umbrella body; and moreover, the structure facilitates the stretching operation of the umbrella column, improves the operating convenience, and is conveniently used by the user.

Features of the present invention can be understood clearly with reference to the detailed description of drawings and preferred embodiments below.

DETAILED DESCRIPTION OF THE EMBODIMENTS

In order to make the technical means, creative features, achieved objectives, and effects easy to understand, the present invention will be further elaborated by combining the specific illustration.

Figure 1:
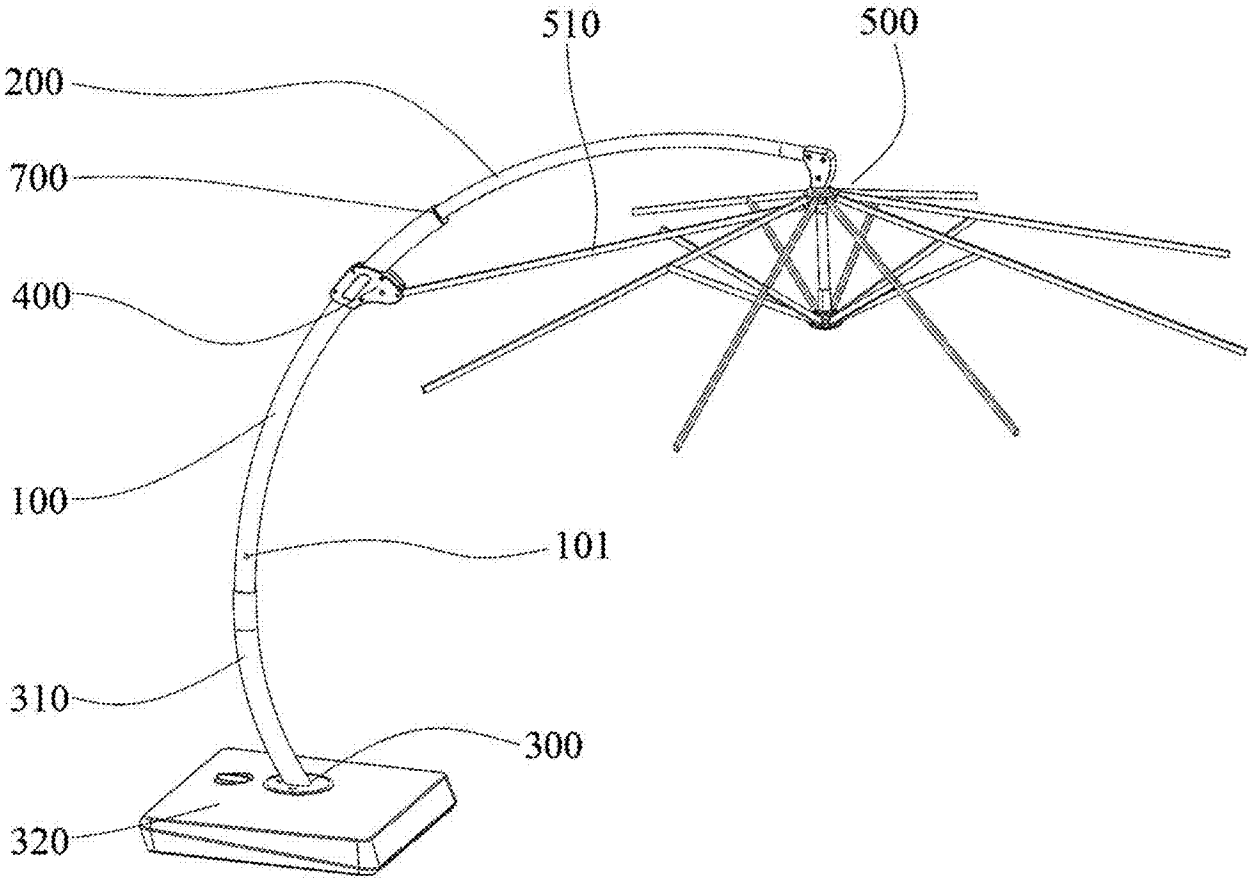
FIG. 1 is an overall structural schematic diagram I of the present invention.
Figure 2:
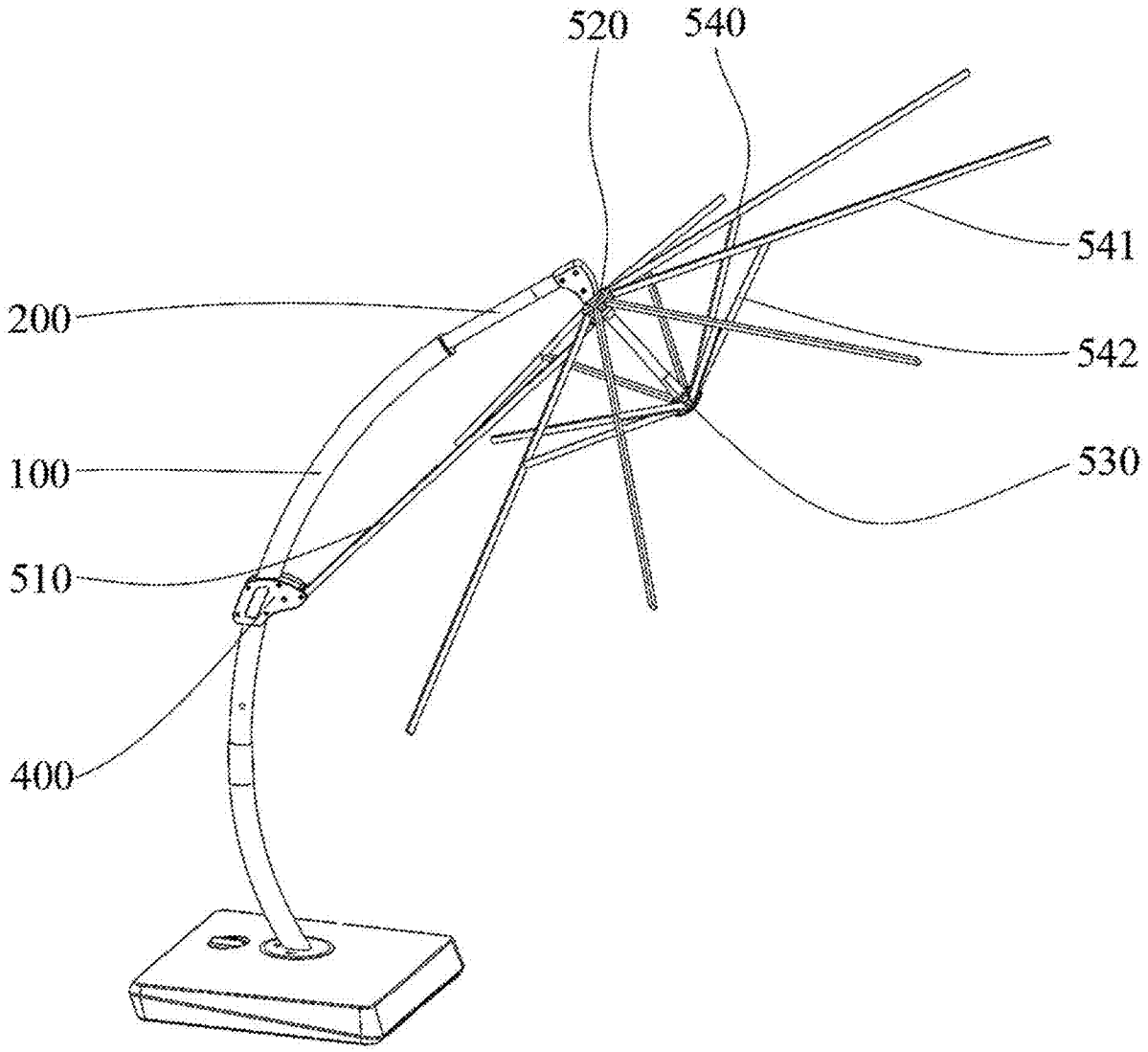
FIG. 2 is a second overall structure diagram II of the present invention.
Figure 3:
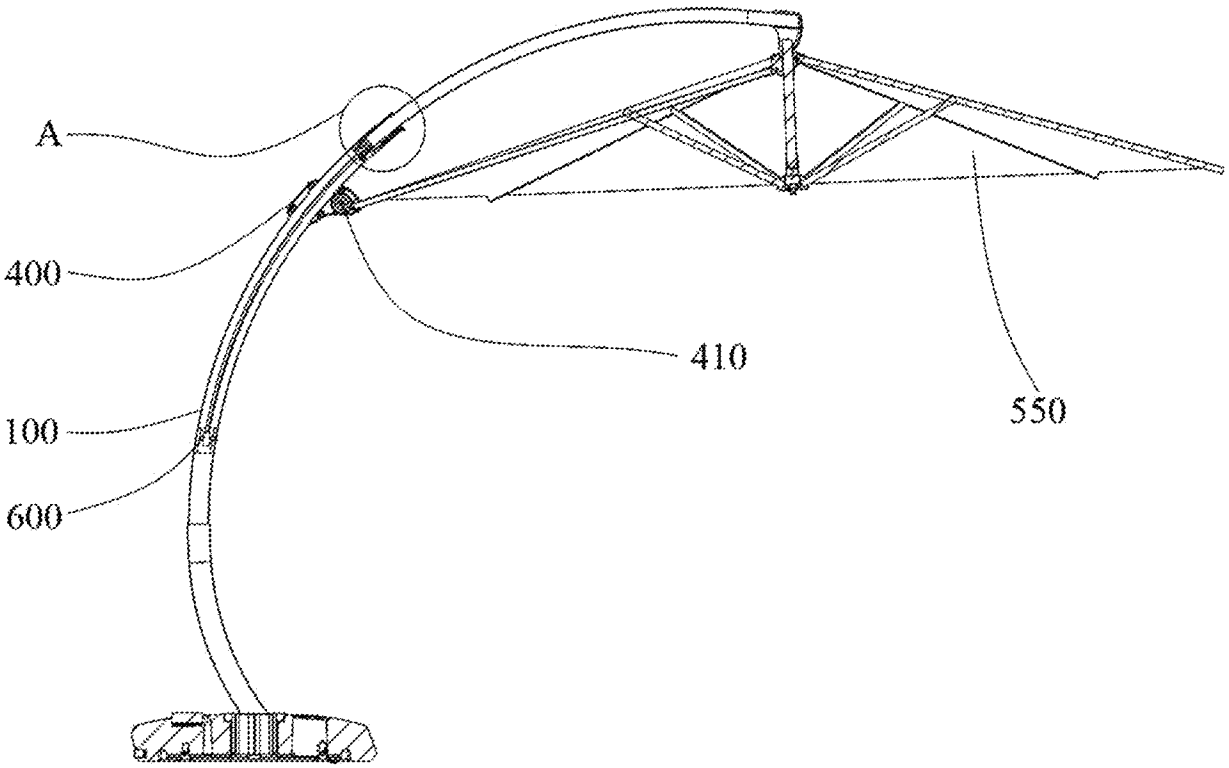
FIG. 3 is an overall sectional structural schematic diagram of the present invention.
Figure 4:
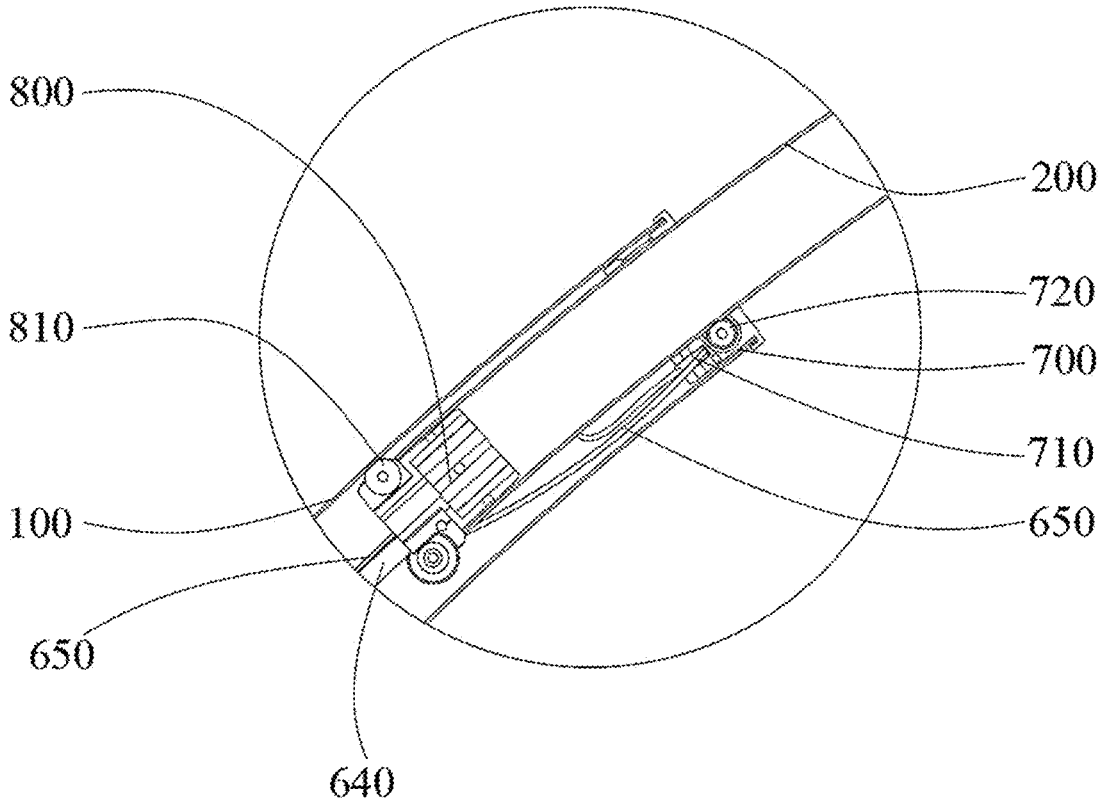
FIG. 4 is a partially enlarged structural schematic diagram of a part A in FIG. 3.
Figure 5:
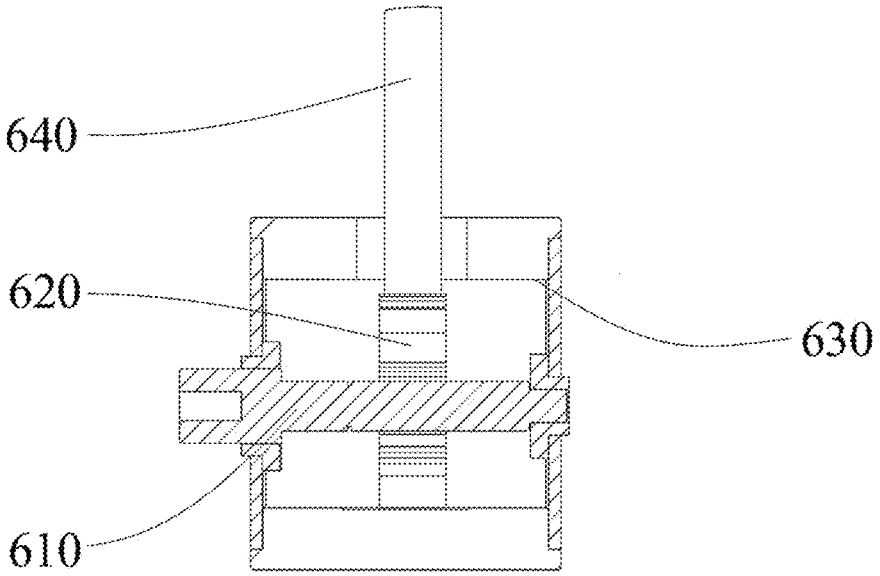
FIG. 5 is a partially sectional schematic structural diagram of an operating mechanism of the present invention.
Figure 6:
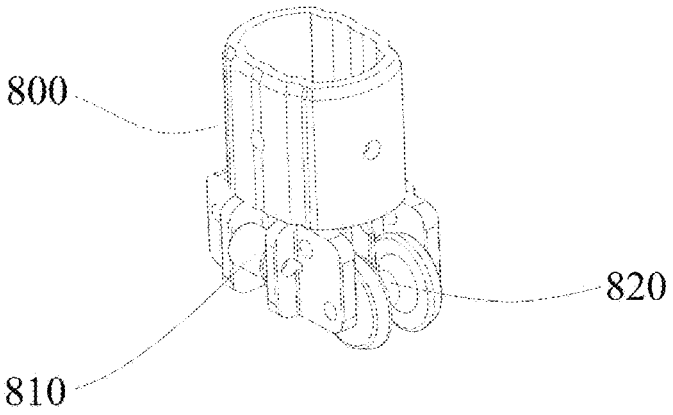
FIG. 6 is a structural schematic diagram of a first mounting seat of the present invention.
Figure 7:
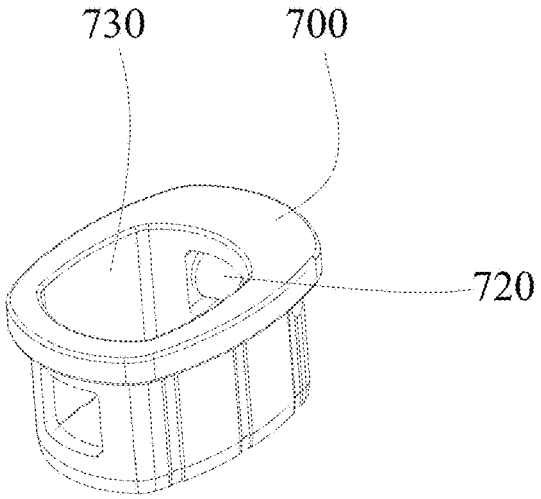
FIG. 7 is a structural schematic diagram of a second mounting seat of the present invention.
Figure 8:
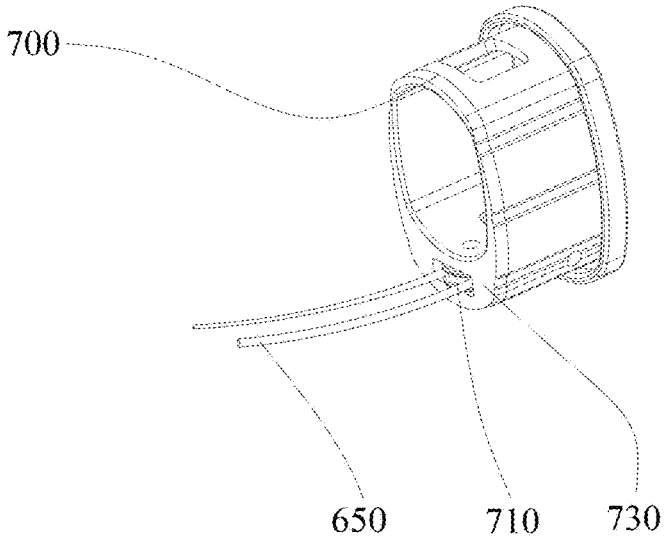
FIG. 8 is a structural schematic diagram of a second mounting seat of the present invention.
Figure 9:
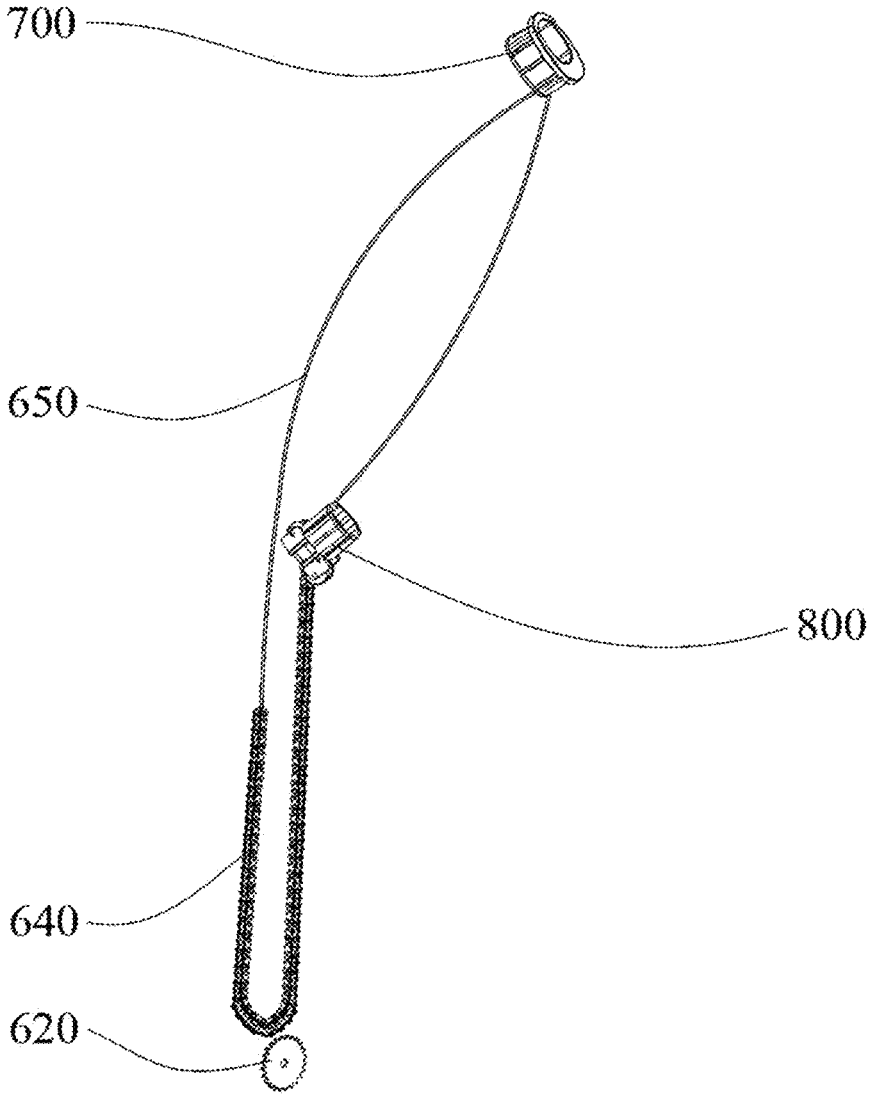
FIG. 9 is a schematic structural diagram I of overall arrangement of the operating structure of the present invention.
Figure 10:
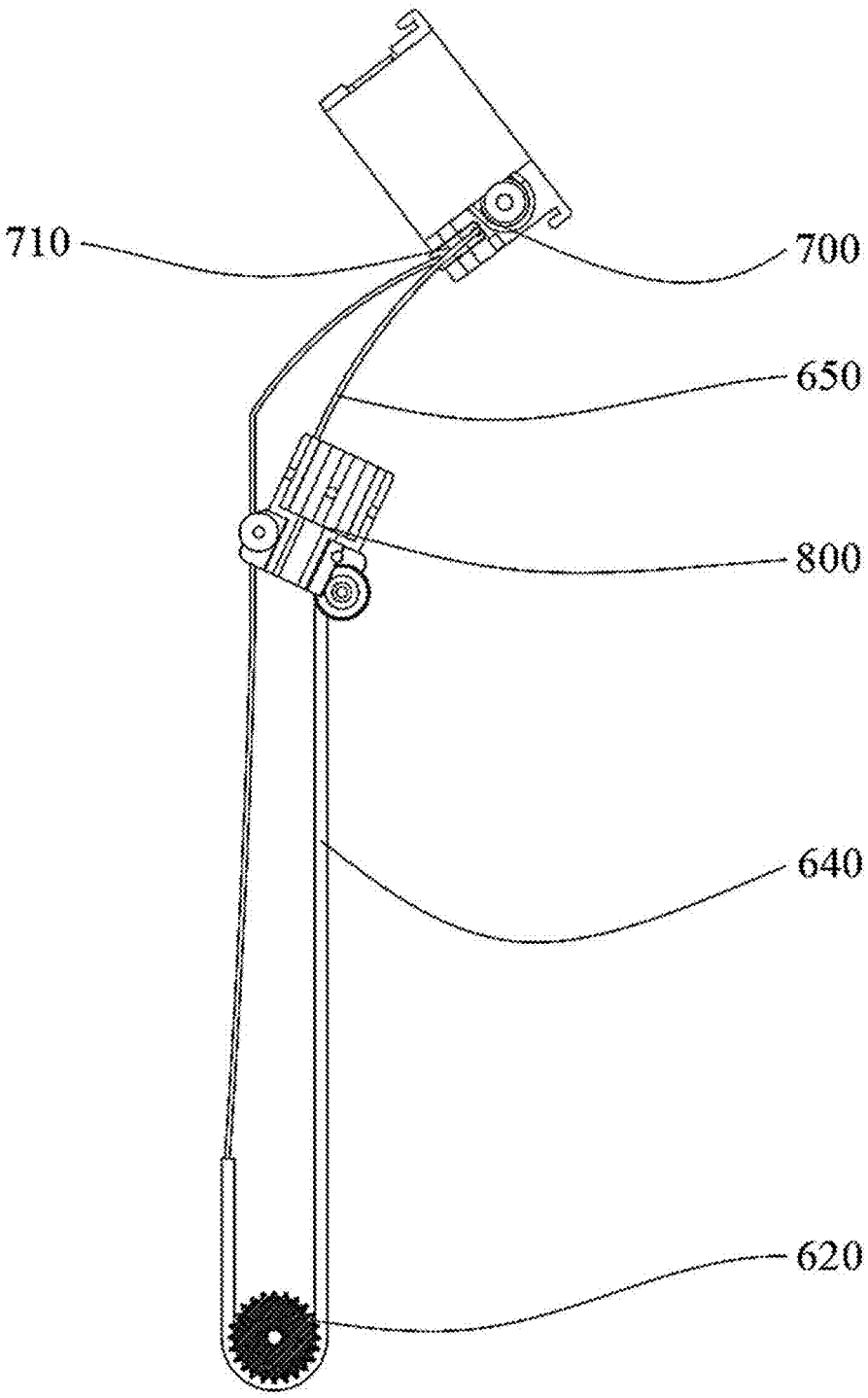
FIG. 10 is a schematic structural diagram II of overall arrangement of the operating structure of the present invention.
Figure 11:
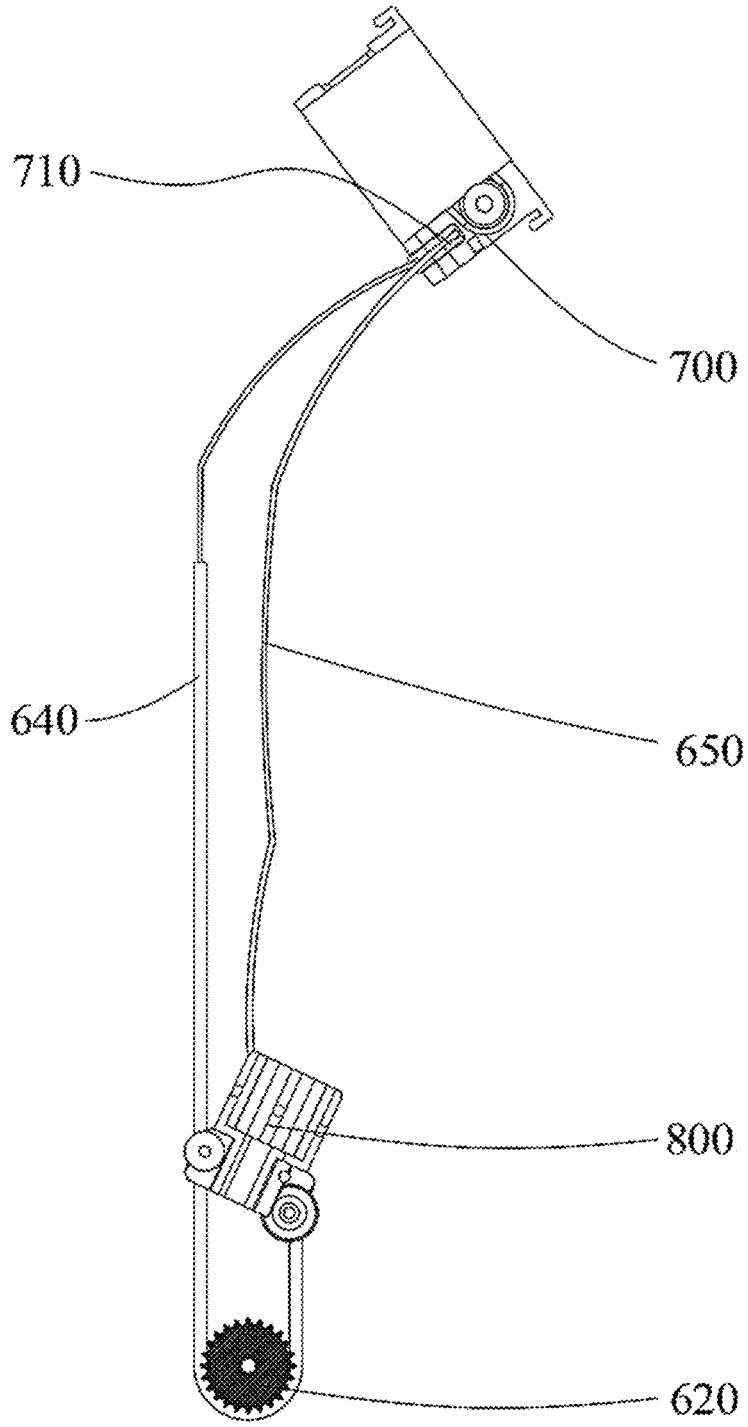
FIG. 11 is a schematic structural diagram III of overall arrangement of the operating structure of the present invention.

In combination with FIG. 1 and FIG. 11, the present invention discloses a curved pipe umbrella with a structure for adjusting an inclination angle of an umbrella body, including a curved pipe umbrella column. The curved pipe umbrella column includes a first curved pipe umbrella column 100 and a second curved pipe umbrella column 200. The second curved pipe umbrella column 200 is usually located on an upper portion of the first curved pipe umbrella column 100. One end of the second curved pipe umbrella column 200 is embedded into an upper inner cavity of the first curved pipe umbrella column 100 and the other end thereof extends outward to match with the umbrella body 500. The umbrella body 500 is hoisted outside the curved pipe umbrella columns. A pole bracket 510 is arranged in the umbrella body 500 and matches with the first curved pipe umbrella column 100 through a sliding seat 400. The sliding seat 400 is capable of moving freely up and down along the first curved pipe umbrella column 100. With the movement of the sliding seat 400 in position, different inclination angles of the umbrella body 500 can be driven to be adjusted.

Usually, the lower portion of the first curved pipe umbrella column 100 will match with the umbrella column base 300. The umbrella column base 300 includes a base body 320 and an umbrella column pedestal 310. The lower portion of the first curved pipe umbrella column 100 is fixedly mounted with the umbrella column pedestal 310 in a matched manner.

In a specific structure, the curved pipe umbrella further includes an operating mechanism 600, where the operating mechanism 600 is configured to drive the second curved pipe umbrella column 200 to be folded toward the inner cavity of the first curved pipe umbrella column 100 or extend outward. When the operating mechanism 600 drives the second curved pipe umbrella column 200 to stretch and retract, a sliding seat 400 can move along different positions of the first curved pipe umbrella column 100; when the second curved pipe umbrella column 200 is completely folded in the first curved pipe umbrella column 100, in this case, the curved pipe umbrella column is in the shortest state, the second curved pipe umbrella column 200 is driven by the operating mechanism 600 to extend outward, and as the second curved pipe umbrella column 200 extends outward, the position of the umbrella body 500 changes; the umbrella body 500 extends outward continuously and is continuously elevated along with the second curved pipe umbrella column 200, and in this case, the pole bracket 510 in the umbrella body 500 also moves in position therewith; the pole bracket 510 drives the sliding seat 400 to move upward along the first curved pipe umbrella column 100, the moving track of which is along the outer surface of the first curved pipe umbrella column 100, an arc-shaped track of the first curved pipe umbrella column 100 till the second curved pipe umbrella column 200 stretches to the outermost end; in this case, the curved pipe umbrella column is in the longest state, and usually, when the umbrella body 500 is in an unfolded state, the umbrella body 500 is in a horizontal state; on the contrary, the operating mechanism 600 is operated, so that the second curved pipe umbrella column 200 retracts inward along the inner cavity of the first curved pipe umbrella column 100, and the umbrella body 500 is in the unfolded state; as the top position of the umbrella body 500 changes, the pole bracket 510 changes therewith to drive the sliding seat 400 to move downward itself along the first curved pipe umbrella column 100, so as to adjust the inclination angle of the umbrella body 500.

With the movement of the sliding seat 400 in position, different inclination angles of the umbrella body 500 can be adjusted. The sliding seat 400 moves in position along with the movement of the pole bracket 510, which is a passive moving state.

Preferably, the umbrella body 500 further includes umbrella cloth 550 and an umbrella stand, where the umbrella cloth 550 covers the umbrella stand, and the umbrella stand includes an upper umbrella tray 520, a lower umbrella tray 530, and an umbrella rib assembly 540; the umbrella rib assembly 540 usually includes a plurality of long umbrella ribs 541 and a plurality of short umbrella ribs 542, where one end of each of the long umbrella ribs 541 matches with the upper umbrella tray 520 in a matched manner and the other end thereof stretches freely outward; one end of each of the short umbrella ribs 542 matches with the lower umbrella tray 530 in a hinged manner and the other end thereof matches with a middle portion of each of the long umbrella ribs 541; a folding and unfolding structure of the umbrella stand is a folding and unfolding structure of an outdoor umbrella in the prior art; usually, as the lower umbrella tray 530 gets close to the upper umbrella tray 520, the umbrella stand is unfolded; and as the lower umbrella tray 530 is away from the upper umbrella tray 520, the umbrella stand retracts. The second curved pipe umbrella column 200 is configured to match with the upper umbrella tray 520 for mounting, and the other end of the pole bracket 510 matches with the upper umbrella tray 520 for mounting.

Combined with the above, the umbrella unfolding and folding mechanism 410 is arranged in the sliding seat 400. The umbrella unfolding and folding mechanism 410 is configured to unfold or fold the umbrella body. The umbrella unfolding and folding mechanism 410 usually includes a rope winding wheel and an umbrella rope. The rope winding wheel is configured to encircle the umbrella rope to roll or loosen the umbrella rope. As the rope winding wheel rolls the umbrella rope, the umbrella stand can be unfolded. On the contrary, the umbrella stand retracts, and the other end of the umbrella rope is usually fixed with the lower umbrella tray 530 in a matched manner. A specific structure of the umbrella unfolding and folding mechanism can refer to an umbrella unfolding and folding mechanism commonly used in the Roman umbrella in the prior art.

In combination with the above, the operating mechanism 600 includes a rotating shaft 610, a rotating gear 620 arranged on the rotating shaft 610, a chain 640 matching with the rotating gear 620 in a surrounding manner, and a winding rope 650 matching with the chain 640, where one end of the chain 640 is fixedly mounted with the winding rope 650 and the other end thereof matches with a first mounting seat 800 for mounting, and the winding rope 650 surrounds behind a pulley 710 in a second mounting seat 700 and extends to match with the first mounting seat 800 for mounting; the winding rope 650, the chain 640, the first mounting seat 800, the pulley 710, and the rotating gear 620 form a closed ring; with rotation of the rotating gear 620, the chain 640 is capable of being driven to move; the chain 640 pulls the winding rope 650 to move and drives the first mounting seat 800 to move along the inner cavity of the first curved pipe umbrella column 100, and the first mounting seat 800 drives the second curved pipe umbrella column 200 to stretch and retract in the inner cavity of the first curved pipe umbrella column 100; by optimizing a combinational design of the chain 6540 and the winding rope 650, the overall closed ring is divided into upper and lower portions, where the upper portion is mainly the winding rope 650 and the lower portion is mainly the chain 640; as the chain 640 and the rotating gear 620 match with each other, with the rotation of the rotating gear 620, the chain 640 can be driven to move, and the chain 640 and the rotating gear 620 match with each other, under no action of an external force, effective locking can be achieved; the upper portion uses the structure of the winding rope 650, the winding rope 650 is preferably a steel wire rope, and the winding rope 650 is of a flexible structure; therefore, the winding rope matches with the upper pulley 710 conveniently, the winding direction of the pulley 710 and the winding direction of the rotating gear 620 are staggered at 90°. Therefore, the upper portion preferably uses the structure of the winding rope 650, reversing can be achieved by using the winding rope 650, and the overall closed ring can rotate.

The first mounting seat 800 is fixedly mounted on the lower portion of the second curved pipe umbrella column 200. Preferably, the first mounting seat 800 is fixed at a lower port of the second curved pipe umbrella column 200 and is embedded into the inner cavity of the first curved pipe umbrella column 100. A roller 810 is further provided in the first mounting seat 800, and the roller 810 is configured to match with an inner cavity wall of the first curved pipe umbrella column 100, so that sliding is achieved conveniently, and the stretching and retracting smoothness of the second curved pipe umbrella column 200 is improved; the second mounting seat 700 is fixed on the upper portion of the first curved pipe umbrella column 100, a transition wheel 820 can further be provided in the second mounting seat 700, and the transition wheel 820 is configured to match with the winding rope 650 in use, so that transition of the winding rope 650 is facilitated. Preferably, the second mounting seat 700 penetrates through the umbrella column through cavity and can stretch and move along the umbrella column through cavity; a roller 720 is further provided on the second mounting seat 700, and the roller 720 is configured to slide on the outer side wall of the second curved pipe umbrella column 200 to increase the stretching and retracting smoothness of the second curved pipe umbrella column 200; and a pulley seat 730 is provided in the second mounting seat 700, and the pulley seat 730 is configured to mount the pulley 710 in a matched manner.

In combination with the above, a specific stretching and retracting principle of the curved pipe umbrella column is as follows: when the curved pipe umbrella column needs to stretch from the shortest state to the longest state, the first mounting seat 800 is at the lowest horizontal height; with the rotation of the rotating gear 620, the chain 640 is driven to move, the chain 640 located on the first mounting seat 800 is in an upward moving state, and the winding rope 650 fixed with the chain 640 is located on the other side and is tightened by the chain 640, and in this case, the chain is a pull-down movement; the winding rope 650 moves downward as the chain 640 is pulled down, after the winding rope 650 is reversed by the pulley 710, the other end of the winding rope 650 is fixed with the first mounting seat 800, the winding rope 650 drives the first mounting seat 800 to move upward, so that the first mounting seat 800 moves upwards with the inner cavity of the first curved pipe umbrella column 100 to drive the second curved pipe umbrella column 200 to stretch outward; on the contrary, when the first mounting seat 800 is at the highest horizontal height position, in this case, the curved pipe umbrella column is in the longest state, with the rotation of the rotating gear 620, the chain 640 is driven to rotate, the chain 640 located on the first mounting seat 800 is in the downward moving state, the chain 640 on the other side is in the upward moving state, and the corresponding winding rope 650 is also in upward moving state; as the chain 640 at the first mounting seat 800 is pulled down, after the winding rope 650 is reversed by the pulley 710, the other end of the winding rope 650 is fixed with the first mounting seat 800 in a loosened state, the chain 640 drives the first mounting seat 800 to move downward, and therefore, the first mounting seat 800 moves downward with the inner cavity of the first curved pipe umbrella column 100 to drive the second curved pipe umbrella column 200 to retract inward.

In one of the preferred embodiments, the rotating shaft 610 is driven by the handle to rotate, and as the rotating shaft 610 is driven by the handle to rotate, the rotating gear rotates.

In one of the preferred embodiments, the rotating shaft 610 is driven by the motor to rotate, and as the rotating shaft 610 is driven by the motor to rotate, the rotating gear rotates.

In one of the preferred embodiments, the rotating shaft 610 in combination with an engaging and disengaging gear can achieve rotation of the handle or the motor, so that manual or electric integrated arrangement is achieved. The engaging and disengaging gear is configured to switch handle rotation or motor rotation and is a common mechanism in the prior art.

In one of preferred embodiments, a third mounting seat 630 is arranged outside the rotating shaft 610 and the rotating gear 620, and the third mounting seat 630 is embedded into the inner cavity of the first curved pipe umbrella column 100; the third mounting seat 630 usually includes a first shell and a second shell, where the first shell and the second shell match oppositely, an accommodating cavity for accommodating the rotating gear 620 and the rotating shaft 610 is formed inside, and one end of the rotating shaft 610 penetrates through the second shell and corresponds to an axle hole in the first curved pipe umbrella column 100, so that the handle is in abutted fit; and the third mounting seat 630 is of an embedded structure, which can improve the overall aesthetic appearance of the external curved pipe umbrella column.

In the rest of the embodiments, the third mounting seat 630 can also be an external shell structure.

According to the present disclosure, by optimally designing the operating mechanism, the second curved pipe umbrella column can stretch and retract in the inner cavity of the first curved pipe umbrella column conveniently. In combination with the pole bracket and the sliding seat, with the movement of the second curved pipe umbrella column, the sliding seat can be synchronously driven to move to adjust different inclination angles of the umbrella body; and moreover, the structure facilitates the stretching operation of the umbrella column, improves the operating convenience, and is conveniently used by the user.

The above is merely the preferred implementation of the present invention rather than a limitation to the present invention in any form. Any simple alternations, equivalent changes and modifications made to the above embodiments based on the technical principle of the present invention shall all fall within the scope of the technical solution of the present invention.

What is claimed is:

1. A curved pipe umbrella with a structure for adjusting an inclination angle of an umbrella body, comprising a curved pipe umbrella column, wherein the curved pipe umbrella column comprises a first curved pipe umbrella column and a second curved pipe umbrella column, one end of the second curved pipe umbrella column is embedded into an upper part of an inner cavity of the first curved pipe umbrella column and the other end thereof extends outward to match with the umbrella body, and a pole bracket is arranged in the umbrella body and one end of the pole bracket matches with the first curved pipe umbrella column through a sliding seat;

the curved pipe umbrella further comprising an operating mechanism configured to drive the second curved pipe umbrella column to be folded toward the inner cavity of the first curved pipe umbrella column or extend outward, wherein when the operating mechanism drives the second curved pipe umbrella column to stretch and retract, the sliding seat is capable of moving along different positions of the first curved pipe umbrella column, wherein the operating mechanism comprises a rotating shaft, a rotating gear arranged on the rotating shaft, a chain matching with the rotating gear in a surrounding manner, and a winding rope matching with the chain, one end of the chain is fixedly mounted with the winding rope and the other end thereof matches with a first mounting seat for mounting, and the winding rope surrounds behind a pulley in a second mounting seat and extends to match with the first mounting seat for mounting.

2. The curved pipe umbrella with a structure for adjusting an inclination angle of an umbrella body according to claim 1, wherein different inclination angles of the umbrella body are capable of being adjusted with the movement of the sliding seat.

3. The curved pipe umbrella with a structure for adjusting an inclination angle of an umbrella body according to claim 2, wherein the umbrella body further comprises umbrella cloth and an umbrella stand, the umbrella cloth covers the umbrella stand, the umbrella stand comprises an upper umbrella tray, a lower umbrella tray, and an umbrella rib assembly, the second curved pipe umbrella column is configured to match with the upper umbrella tray for mounting, and the other end of the pole bracket matches with the upper umbrella tray for mounting.

4. The curved pipe umbrella with a structure for adjusting an inclination angle of an umbrella body according to claim 3, wherein an umbrella unfolding and folding mechanism is arranged in the sliding seat to unfold or fold the umbrella body.

5. The curved pipe umbrella with a structure for adjusting an inclination angle of an umbrella body according to claim 1, wherein the winding rope, the chain, the first mounting seat, the pulley, and the rotating gear form a closed ring; with rotation of the rotating gear, the chain is capable of being driven to move; the chain pulls the winding rope to move and drives the first mounting seat to move along the inner cavity of the first curved pipe umbrella column, and the first mounting seat drives the second curved pipe umbrella column to stretch and retract in the inner cavity of the first curved pipe umbrella column.

6. The curved pipe umbrella with a structure for adjusting an inclination angle of an umbrella body according to claim 5, wherein the first mounting seat is fixedly mounted on a lower portion of the second curved pipe umbrella column and is embedded into the inner cavity of the first curved pipe umbrella column, and the second mounting seat is fixed on an upper portion of the first curved pipe umbrella column.

7. The curved pipe umbrella with a structure for adjusting an inclination angle of an umbrella body according to claim 6, wherein an umbrella column through cavity is formed in the second mounting seat, the second curved pipe umbrella column penetrates through the umbrella column through cavity and is capable of stretching and retracting along the umbrella column through cavity, a pulley seat is arranged in the second mounting seat, and the pulley seat is configured to mount the pulley in a matched manner.

8. The curved pipe umbrella with a structure for adjusting an inclination angle of an umbrella body according to claim 7, wherein the rotating shaft is driven by a motor and/or a handle to rotate, and a third mounting seat is arranged outside the rotating shaft and the rotating gear.

9. The curved pipe umbrella with a structure for adjusting an inclination angle of an umbrella body according to claim

8, wherein the third mounting seat is embedded into the inner cavity of the first curved pipe umbrella column.

* * * * *